United States Patent [19]

Andrychuk

[11] 4,083,352

[45] Apr. 11, 1978

[54] METHOD FOR CUTTING ORNAMENTAL TRANSPARENT GEMSTONES AND PRODUCTS PRODUCED THEREFROM

[76] Inventor: Dmetro Andrychuk, 422 Terrace Dr., Richardson, Tex. 75081

[21] Appl. No.: 763,404

[22] Filed: Jan. 28, 1977

[51] Int. Cl.[2] ..... B28D 5/00

[52] U.S. Cl. ..... 63/32; 51/283 R; 125/30 R

[58] Field of Search ..... 51/281 R, 283; 125/30 R; 63/32

[56] References Cited

U.S. PATENT DOCUMENTS

| | | | |
|---|---|---|---|
| 3,039,280 | 6/1962 | Flad | 63/32 |
| 3,528,261 | 9/1970 | Jones | 63/32 |
| 3,585,764 | 6/1971 | Huisman | 125/30 R |
| 3,665,729 | 5/1972 | Elbe | 63/32 |

*Primary Examiner*—Harold D. Whitehead

[57] ABSTRACT

This invention relates generally to a method for systematically and accurately increasing the brilliance and depth of color of a gemstone without the need to determine the pavilion and facet angles by trial and error.

22 Claims, 9 Drawing Figures

METHOD FOR CUTTING ORNAMENTAL TRANSPARENT GEMSTONES AND PRODUCTS PRODUCED THEREFROM

BACKGROUND OF THE INVENTION

The present invention relates to the method and resulting cut gemstone of any natural or synthetic refractive material such as diamond, zirconia, ruby, sapphire or emerald of a given refractive index wherein for increased brilliance and depth of color the angles at which the crown (the top half of the stone) and pavilion main facets (the bottom half of the stone) are cut and determined in accordance wit a mathematical formula.

The prior art discloses a number of arrangements for the pavilion and crown main facets including variations of the shape, size and number of each. In all cases it appears that the range of values given for the angle between the crown and pavilion main facets and the plane of the table of the stone were determined by custom or trial and error. No systematic approach to a determination of these angles either for existing gemstone materials or materials yet undiscovered has been explained or explored. Further, no distinction has been drawn between deriving such angles for increased brilliance versus improved depth of color.

Heretofore, no empirical relationship has been used to determine accurately the relationship between the crown and pavilion main facets for a refractive gemstone of a given index of refraction. For examples: U.S. Pat. No. 693,084, Feb. 11, 1902, granted to A. C. Townsend, gives a pattern and position of the facets about the gem but does not demonstrate a way of determining the angles with respect to the axis of the stone. U.S. Pat. No. 2,340,659, Feb. 1, 1944, granted to E. Goldstein gives positions for the facets for improved brilliancy but there is no demonstration of how the angles were determined. Similarly, U.S. Pat. No. 3,286,486, granted Nov. 22, 1966 to James and Harry Huisman discloses an improved arrangement of the pavilion facets including both an increase in the number and improved shape of the facets without giving reasons for the angles. U.S. Pat. No. 3,788,097, granted to Maxims Elbe, Jan. 29, 1974, discloses a range of values for the angle between the pavilion plane and plane of the table of the stone as derived from the prior art methods of cutting, but no explanation is given as to how this range was determined. Instead, the number and configuration of the facets is improved to give increased brilliance and a strong dispersion of colored light or sparkle.

The May 30, 1972 U.S. Patent of Maxims Elbe, 3,665,729, further refines the arrangement of the crown and pavilion facets and the relationship between them but no teaching of how to determine the relationship between the crown and pavilion main facets in different indexes of refraction.

As an illustration of further prior art, the text book, *Gem Cutting, A Lapidary Manual,* by John Sinkankas (1962) lists a single angle for the pavilion main facets and a range of values for the crown main facets for the known gemstone materials. There is no teaching for the derivation of such angles.

There are two factors which make one transparent gem stone more beautiful than the other - brilliancy and color. All cutting angles are aimed at increasing the brilliancy and creating the exact degree of color desired. Brilliancy is a measure of a stone's ability to return to the eye a maximum amount of the light striking all of the facets above the girdle. Some gemstones are cut for color alone, while light-colored, transparent stones are cut for brilliance as well. Heretofore, depth of color was deepened or lightened by increasing or decreasing the depth of the stone or by decreasing or increasing the angle of the pavilion facets. For example, with tourmaline (dark green) or garnet (deep red), by cutting the pavilion facets shallow, i.e. using lower angles, the stone will be thinner, appearing lighter in color. Similarly light colored stones such as morgamite and kunzite need all the color possible and by increasing the depth of the stone by increasing the pavilion facet angles, the stones gain depth of color.

SUMMARY OF THE INVENTION

A method for determining and cutting a plurality of crown main facets of an ornamental transparent gemstone. The gemstone has a chosen index of refraction n, a chosen angle p to the horizontal axis of the gemstone with a plurality of pavilion main facets, and an optical axis. The method provides for improving the brilliance and depth of color to the gem stone and comprises the steps of choosing a first light ray path to enter the gemstone at a fixed entrance angle to the optical axis of the gemstone. The first light ray's path is then caused to have a plurality of internal reflections within the gemstone and exit the gemstone at an angle parallel to the optical axis. A second light ray path is chosen to enter the gemstone at the same fixed entrance angle as the first light ray path. An angle c to the horizontal axis of the gemstone is determined for the plurality of crown main facets such that the second light ray path will have a plurality of reflections within the gemstone and exit the gemstone at an angle parallel to the optical axis. The plurality of pavilion main facets are cut on the gemstone at the chosen angle p and the plurality of crown main facets are cut on the gemstone at the determined angle c.

Another embodiment of the invention includes the step of causing one of the light paths to have no more than two internal reflections before exiting the gemstone.

Still another embodiment of the invention includes the step of causing one of the light paths to have more than two internal reflections within the gemstone.

Still another embodiment of the invention includes the steps of causing both of the light paths to have more than two internal reflections before exiting the gemstone.

DESCRIPTION OF THE INVENTION

Figure 1:
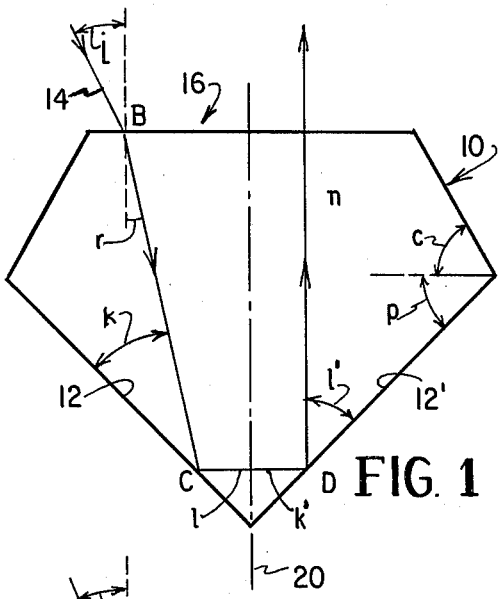
FIGS. 1–9 are diagramatic representations illustrating optical conditions for dispersions of light in the gemstone.

FIG. 1 is a diagramatic representation of a cross-section of a cut gemstone. A crown main facet is generally indicated by the numeral 10 and a pavilion main facet is generally indicated by the numeral 12. A ray of light 14 enters a stone at a table 16 at an angle *i*. In accordance with Snell's Law $$\frac{\sin(i)}{\sin(r)} = n$$

where $i$ = angle of incidence, $r$ = the angle of refraction and $n$ = the index of refraction of the gemstone material. The light ray 14 enters the table 16 at point B and is reflected internally twice, at points C and D on the interior surface of the gemstone pavilion facets 12 and 12' respectively. Light ray 14 forms an angle k and an angle 1 at point C with the pavilion surface 12. In accordance with the laws of reflection, angle $k$ equals angle 1 where $k$ is equal to the angle of incidence and 1is equal to the angle of reflection.

For maximum brilliance, as much entering light as possible should be directed back into the eye of the viewer. Since the viewer will ordinarily be viewing the stone at a point some distance away from the stone and at a point near a line describing an optical axis of the stone 20, applying the condition that the entering light should be emitted parallel to the optical axis 20, describes a condition maximizing the brilliance of the cut gemstone. The crown main and the pavilion main angles are designated as crown main and pavilion main angles $c$ and $p$ respectively. Utilizing the laws of refraction, reflection and trigonomitry, it can be shown that:

$$i = \text{arc sin}\,[n \sin (4p\text{-}180°)] \tag{1}$$

For a material of a given refractive index, the pavilion main facet angle $p$ may be described in equation (1) for the ray of light 14 of FIG. 1.

Figure 2:
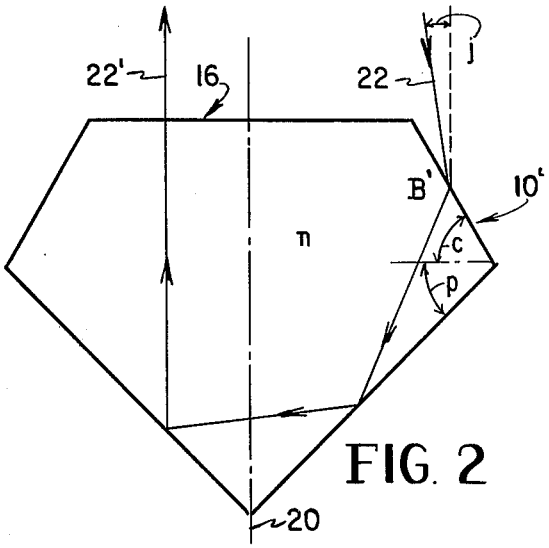

FIG. 2 shows a second light path for a ray of light 22 which enters the crown main facet 10 at point B' and makes an angle $j$ with the optical axis 20 of the stone. Applying the condition for increased brilliance, where the ray 22 exits the stone at the table 16 and in a direction parallel to the optical axis 20, it can be shown by applying mathematical principles that $$j = \textit{arc sin}\,[n \sin (c+4p-180°)] - c \tag{2}$$

For a material of a given refractive index $n$, the values of $c$, the crown main angle, and $p$, the pavilion main angle, may be calculated for any selected values of $j$, $n$ or $p$.

To further increase the brilliance of the stone, equations (1) and (2) can be solved simultaneously. If light entering the stone is emitted from a distant source, and equating the angles of incidence for equations (1) and (2) results in the following relationship:

$$c = \text{arc tan}\left[\frac{2n \sin (180° - 4p)}{n \cos (180° - 4p) - \sqrt{1 - n^2 \sin^2 (180° - 4p)}}\right] \tag{3}$$

Equation (2) may be plotted graphically for any material $n$. Where the two equations have $i = j$ for any selected value of $c$ gives the value for $p$. This is a graphical method for solving equations (1) and (2) and may be used instead of mathematical method used to derive equation (3).

By using equation (3) for a given pavilion main facet angle p, the crown facet angle $c$ may be calculated and the condition that parallel rays entering both the crown main facets 10 and the table 16 will leave via the table of the stone and in a direction parallel to the optical axis of the stone. Equation (3) may be used to determine the crown main facet angle for any value of the pavilion main facet angle for any material of a given index of refraction. Accordingly, exiting ray 22 shown as 22' exits perpendicular to the table 16 and parallel to the optical axis of the stone 20, thereby increasing the brilliance.

Figure 3:
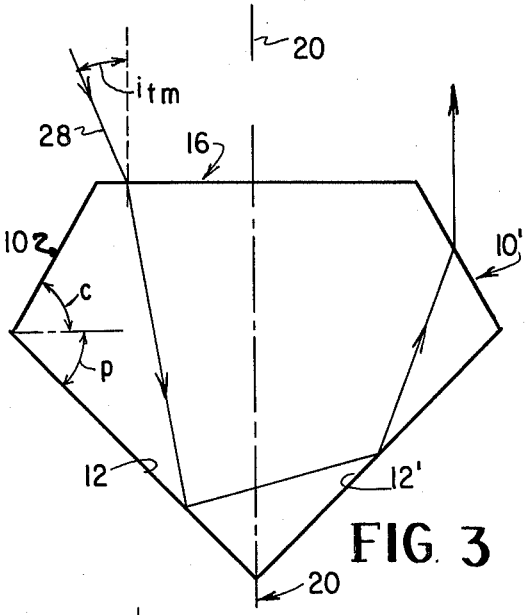

Yet another optical path for increased brilliance is shown with reference to FIG. 3. A ray of light 28 enters the table 16 of the stone at an angle $i_{tm}$ and leaves the stone via the crown main facet 10' parallel to the optical axis 20 of the stone. The mathematical relationship describing the angle $i_{tm}$ is:

$$i_{tm} = \text{arc sin}\left\{ n \sin [(2c + 4p - 180°) - \text{arc sin}\,(\frac{\sin c}{n})] \right\} \tag{4}$$

Equation (4) when combined analytically or graphically with equation (1) thus eliminating the incident angle of the ray of light, provides an expression relating the crown main facet angle 10 to the pavilion main facet angle 12. Equation (4), when graphically or analytically combined with equation (2), provides a range of matched values for angles $c$ and $p$ which allow the simultaneous occurrence of the optical path described by equations (2) and (4). Accordingly, the stone brilliance is enhanced since the exiting rays from the relatively same distant light source enter either the table 16 or a crown main facet 10 and are effected twice by the interior surfaces of the pavilion main facet 12 and exit parallel to the optical axis 20 of the stone via the crown main facet 10.

Figure 4:
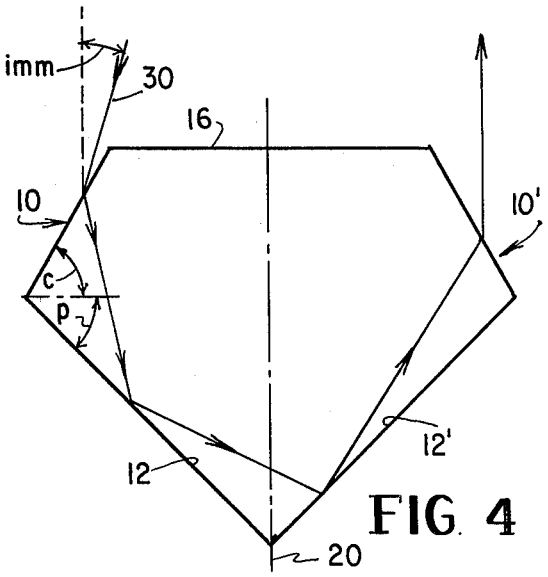

Yet a fourth optical path satisfying the condition for increased brilliance is a ray 30, shown in FIG. 4 which enters the stone at the crown main facet 10 reflected twice by the interior surface of the pavilion main facet 12 and 12', and exits through the opposite crown main facet 10' in a direction parallel to the optical axis 20. The expression relating the crown and pavilion main facet angles $c$ and $p$ gives a ray 30 at an angle $i_{mm}$ with respect to the optical axis in accordance with the criterion stated above, is:

$$i_{mm} = \text{arc sin}\left\{ n \sin [(2c + 4p - 180°) - \text{arc sin}\,(\frac{\sin c}{n})] \right\} - c \tag{5}$$

In the manner described above, equation (5), when combined analytically or graphically with the equations previously derived, describes the condition wherein the simultaneous satisfaction of the conditions of equation (5) and the equation with which it is combined is achieved. By setting $i_{mm}$ = to zero, an expression can be derived wherein $c$ and $p$ may be determined for a gemstone with no table.

Thus far, the optical path described a ray of light traversing the gemstone only once before exiting. Attention will now be directed to light rays which traverse the interior of the stone two or more times before exiting. In colored gemstone material such as emeralds, rubies and sapphires, a stone cut in a way such that it would be reflected more than two times (more than two internal reflections) within the stone, before exiting, would exhibit increased depth of color when compared with the stone wherein the light ray traverses the interior of the stone only once.

By combining the conditions describing single and double traverse cuts, a two-toned color stone may be achieved. The double traverse cuts may be accomplished in any one of four ways.

Figure 5:
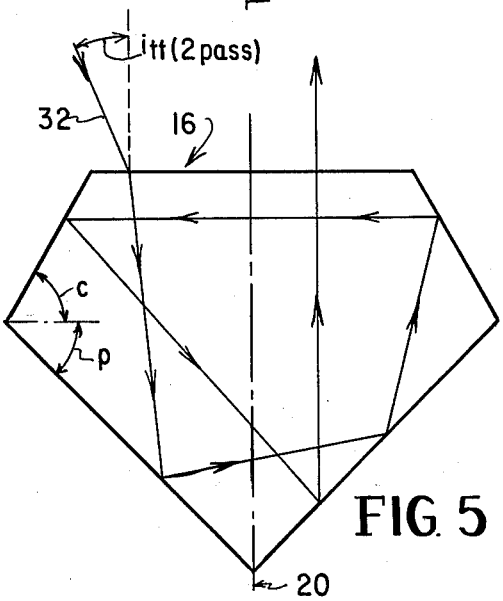

FIG. 5 shows a ray of light 32 entering the gemstone at the table 16 at an angle $i_{tt}$ and traversing the interior of the gemstone twice by internal reflection and exiting via the table 16 in a direction parallel to the optical axis 20 of the stone. The mathematical expression describing angle $i_{tt}$ is:

$$t_{tt}(2\text{pass}) = \text{arc sin } \{n \sin[4(c+p)+4p]\} \quad (6)$$

This double traverse path may be combined with any of the single traverse optical paths described above. Possible combinations may also be derived by trial and error using rule and compass and applying the laws of reflection and refraction.

Figure 6:
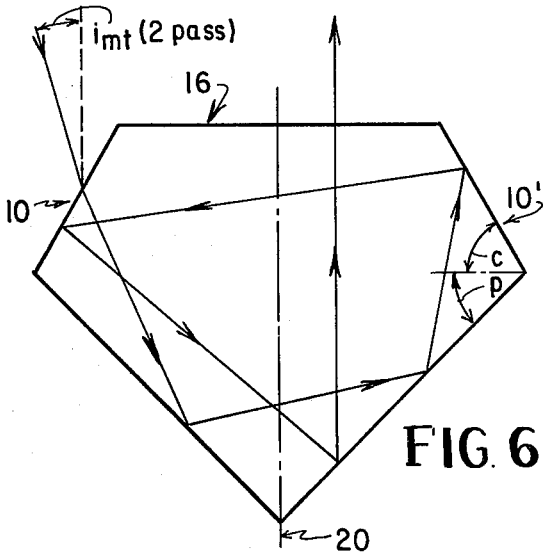

Another double pass in FIG. 6 shows a ray of light entering a crown main facet 10 at an angle $i_{mt}$ traversing the stone twice and leaving the gemstone via the table in a direction parallel to the optical axis. An expression describing this path is:

$$i_{mt}(2\text{pass}) = \text{arc sin } \{n \sin[4(p+c)+4p+c-180°]\} \quad (7)$$

This double pass path may be combined with any single pass path by solving the appropriate equations graphically thereby providing the relationship between the crown and pavilion main facet angles for two-toned gems.

Figure 7:
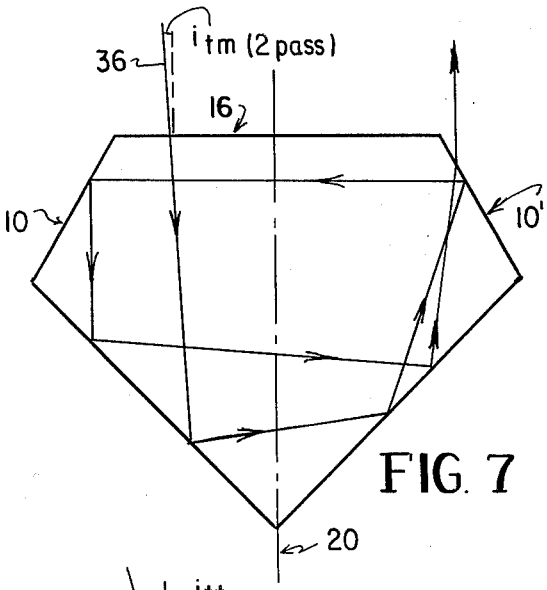

Another double pass in FIG. 7 shows a ray of light 36 entering the gemstone via the table 16 and an angle $i_{tm}$ traversing the interior of the gemstone twice by internal reflection and exiting the gemstone by way of the crown main 10' in a direction parallel to the optical axis 20. An expression describing the angle $i_{tm}$ is as follows:

$$i_{tm}(2\text{pass}) = \text{arc sin } \{n \sin [\text{arc sin } (\frac{\sin c}{n}) - [4(c+p) + 4p + c - 180° ]]\} \quad (8)$$

This double pass optical path may be combined with any of the single path optical paths to provide another distinct two-toned gemstone. The values of the crown and pavilion main facet angles may be obtained by graphically combining equation (8) with the desired single path equation.

Figure 8:
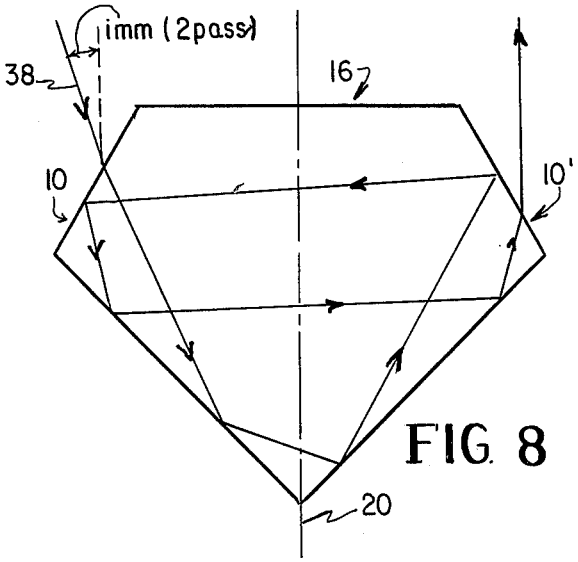

Another double path possibility is shown in FIG. 8 wherein the light ray 38 enters the crown main 10 at an angle $i_{mm'}$, traverses the gemstone twice by interior reflection and exits the stone via the opposite main facet in a direction parallel to the optical axis 20 of the gemstone. The angle $i_{mm}$ is described as follows:

$$i_{mm}(2\text{pass}) = \text{arc sin } \{n \sin[4(p+c) + 4p + 2c - 180° - \text{arc sin } (\frac{\sin c}{N})]\} - c \quad (9)$$

The two pass optical path described by equations (6) through (9) may be combined with any of the single path equations. The optical path described by equations (1), (2), (3), or (4) or derived combinations of two single pass optical equations may be combined with one double pass optical path to create a two-toned gemstone. Numerous other combinations are possible and may be derived by trial and error and using a ruler and compass or simultaneous solution of the equations in accordance with the invention. Simultaneous solutions of the equations can be facilitated by applications of appropriate computer programming.

The equations may further be applied to stones where the pavilion or crown facets are split either horizontally or vertically. If one set of crown facets is at an angle $c_1$ and the other at $c_2$, with respect to the table of the gemstone, and:

$$\frac{c_1 + c_2}{2} = c \quad (10)$$

and similarly for the pavilion angles, and the equations will describe the crown and pavilion facet angles giving increased brilliance and depth of color.

Any number of sets of crown (or if pavilion facet angles, $p$ is substituted for $c$ in the equation (11) below) facet angles may be specified if the following equation is satisfied:

$$\frac{c_1 + c_2 \ldots + c_n}{n} = c \quad (11)$$

It is also possible to describe a ray of light in accordance with the invention that enters a gemstone and traverses the interior by internal reflection $k$ times before exiting. The resulting color of the gem will deepen for larger values of $k$ since the other portions of the spectrum (those portions absorbed by virtue of the light attenuating characteristics of the material involved) will be fully attenuated by the longer optical path within the gemstone and in accordance with the Lambert-Beer law of light attenuation as follows:

$$I_{exit}/I_{enter} = \text{Exp } (-ckL) \quad (12)$$

Where $I_{enter}$ = intensity of incident ray at the specified color; $I_{exit}$ = the intensity of the exit ray at the specified color, $c$ = absorption coeficient of the material at the specified color; $k$ = number of passes through the gemstone; and $L$ = optical path length within the gemstone for a single pass.

A light path wherein a light ray enters the gemstone crown facets at an angle $i_{tm}$ ($k$ pass) and traverses the interior of the gemstone by interior reflection $k$ times, and exit by way of a crown facet in a direction parallel to the optical axis can also be described. Expressions relating the conditions which may be used to determine the values of the crown and pavilion facets mains for a material of a given index of the refraction, $n$, are described by the following equations:

$$i_{tt}(k \text{ pass}) = \text{arc sin } \{n \sin [4(k-1)(c+p)+4p]\} \quad (13)$$

$$i_{mt}(k \text{ pass}) = \text{arc sin } \{n \sin[4(k-1)(p+c)-(4p+c-180°)]\} - c \quad (14)$$

$$i_{tm}(k \text{ pass}) = \text{arc sin } \{n \sin[\text{arc sin}((\sin c/n)) - [4(k-1)(p+c) + 4p+c+180°]]\} \quad (15)$$

$$i_{mm}(k \text{ pass}) = \text{arc sin } \{n \sin[4(k-1)(p+c)+4p+2c-180° \text{ arc sin}(\sin c/n)]\} - c \quad (16)$$

Ray tracing by ruler and compass may be used as well as or instead of equations (13) through (16).

Figure 9:
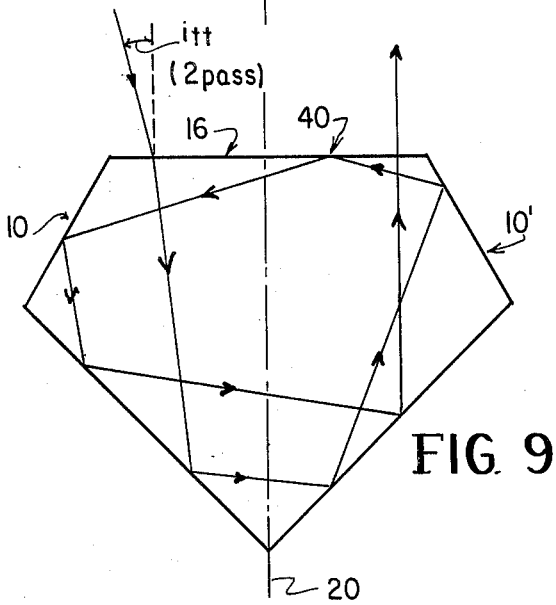

By combining an optical path which makes an internal reflection at a point 40 at the table 16 of the gemstone shown in FIG. 9, with any of the previously stated double pass paths for a different exit and extrance facet or with any of the multiple pass configurations described above, the crown and pavilion mains may be determined by ray tracing with a ruler and compass utilizing the laws of reflection and refraction. Application of this criterion will produce two-toned cut gemstones.

Examples where some of the equations have been used to determine crown main and girdle facet angles as well as pavilion main and girdle facets follow:

EXAMPLE NO. 1

Rectangular cut, (Equation 3)

| | |
|---|---|
| YAG, in = 1.83 | |
| Crown main : | 42.9° |
| Scissor cuts : 38.0, 40.0° | |
| Pavilion main : | 41.8° |
| Scissor cuts : | 44.0° |

EXAMPLE NO. 2

Round cut, (Equation 3)

| | |
|---|---|
| YAG, n = 1.83 | |
| Crown Main | 45.0° |
| Pavilion Main | 41.5° |
| Crown girdle facets | 41.5° |
| Pavilion girdle | 42.0° |

EXAMPLE NO. 3

Round cut, (Equation 3)

| | |
|---|---|
| Sapphire, n = 1.77 | |
| Crown Mains | 49.6° |
| Pavilion mains | 41.0° |
| Crown girdles | 45.5° |
| Pavilion girdles | 41.6° |

EXAMPLE NO. 4

Round two-tone cut, (Equation 9)

| | |
|---|---|
| Ruby, n = 1.77 | |
| Crown main | 46.0° |
| Pavilion mains | 39.2° |
| Pavilion girdles | 39.5° |
| Table must be equal 30% of diameter of stone | |

EXAMPLE NO. 5

Round two-tone cut, (Equation 9)

| | |
|---|---|
| Ruby, n = 1.77 | |
| Crown Main | 47.0° |
| Pavilion Main | 39.0° |
| Pavilion girdles | 39.3° |

EXAMPLE NO. 6

Oval, $i_{tm} = i_{mt} = 0$
Samarium gallium garnet, $n = 1.99$

| | |
|---|---|
| Crown main | 48.0° |
| Pavilion Main | 38.5° |
| Pavilion girdle | 38.5° |
| Equation (2) for $i_{mt}$ and (4) for $i_{tm}$ solved simultaneously. | |

What is claimed to be protected by Letters Patent is:

1. Method for cutting a plurality of crown main facets of an ornamental transparent gemstone having an index of refraction *n*, a chosen angle *p* to the horizontal axis of the gemstone for the plurality of pavilion main facets, and an optical axis, to provide improved brilliance and depth of color to the gemstone, comprising the steps of:

choosing a first light ray path to enter the gemstone at a fixed entrance angle to the optical axis of the gemstone, have a plurality of internal reflections within the gemstone and exit the gemstone at an angle parallel to the optical axis;

choosing a second light ray path to enter the gemstone at said fixed entrance angle;

cutting the plurality of the pavilion main facets on said gemstone at said chosen pavilion angle *p;* and cutting a plurality of crown main facets on the gemstone at an angle *c* to the horizontal axis of the gemstone chosen to allow light entering the gemstone along said second light ray path to have a plurality of reflections within the gemstone and exit the gemstone at an angle parallel to the optical axis.

2. The method as described in claim 1 wherein the step of cutting the plurality of crown main facets includes the step of cutting the plurality of crown main facets at an angle *c* allowing light entering the gemstone along said first light ray path to have only two internal reflections within the gemstone, and exit the gemstone at an angle parallel to the optical axis.

3. The method as described in claim 1 wherein the step of cutting the plurality of crown main facets includes the step of cutting the plurality of crown main facets at an angle *c* allowing light entering the gemstone along the second light ray path to have only two internal reflections within the gemstone and exit the gemstone at an angle parallel to the optical axis.

4. The method as described in claim 2 wherein the step of cutting the plurality of crown main facets includes the step of cutting the plurality of crown main facets at an angle *c* allowing light entering the gemstone along the second light ray path to have only two internal reflections within the gemstone, and exit the gemstone at an angle parallel to the optical axis.

5. The method as described in claim 4 includes the step of cutting said angle *c* such that it is related to *n* and *p* and determined in accordance with a mathematical formula.

6. The method as described in claim 5 wherein the step of cutting the crown main facets at said angle *c* to the horizontal axis is cut such that the angle *c* is mathematically related to *n* and *p* in the following manner:

$$C = \arctan\left[\frac{2n\sin(180^\circ - 4p)}{n\cos(180^\circ - 4p) - \sqrt{1 - n^2\sin^2(180^\circ - 4p)}}\right]$$

7. The method as described in claim 4 wherein the step of cutting the plurality of crown main facets includes the step of cutting the plurality of crown main facets at angle *c* to horizontal axis allowing light entering the second light ray path to enter one of the plurality of crown main facets, have only two internal reflections and exit another of the plurality of crown main facets at an angle parallel to the optical axis.

8. The method as described in claim 4 includes the step of cutting a table at an angle of 90° to the optical axis.

9. The method as described in claim 8 wherein the step of cutting the plurality of crown main facets includes the step of cutting the plurality of crown main facets at angle *c* to horizontal axis allowing light entering the second light ray path to enter the table, have only two internal reflections within the gemstone and exit the table at an angle parallel to the optical axis.

10. The method as described in claim 8 wherein the step of cutting the plurality of crown main facets includes the step of cutting the plurality of crown main facets at angle *c* to horizontal axis allowing light entering the second light ray path to enter one of the plurality of crown main facets, have only two internal reflections and exit the table at an angle parallel to the optical axis.

11. The method as described in claim 8 wherein the step of cutting the plurality of crown main facets includes the step of cutting the plurality of crown main facets at angle *c* to horizontal axis allowing light entering the second light ray path to enter said table, have only two internal reflections and exit one of the plurality of crown main facets at an angle parallel to the optical axis.

12. The method as described in claim 1 wherein the step of cutting the plurality of crown main facets includes the step of cutting the plurality of crown main facets at angle *c* to horizontal axis allowing light entering the second light path to enter the gemstone, have more than two internal reflections within the gemstone and exit the gemstone at an angle parallel to the optical axis.

13. The method as described in claim 12 wherein the step of cutting the plurality of crown main facets includes the step of cutting the plurality of crown main facets at angle *c* to horizontal axis allowing light entering the second light path to enter one of the plurality of crown main facets, have more than two internal reflections within the gemstone and exit another of the plurality of crown main facets at an angle parallel to the optical axis.

14. The method as described in claim 12 includes the step of cutting a table at an angle of 90° to the optical axis.

15. The method as described in claim 14 wherein the step of cutting the plurality of crown main facets includes the step of cutting the plurality of crown main facets at angle *c* to horizontal axis allowing light entering the second light ray path to enter the table, have more than two internal reflections within the gemstone and exit the table at an angle parallel to the optical axis.

16. The method as described in claim 14 wherein the step of cutting the plurality of crown main facets includes the step of cutting the plurality of crown main facets at angle *c* to horizontal axis allowing light entering the second light ray path to enter the table, have more than two internal reflections within the gemstone and exit one of the plurality of crown main facets at an angle parallel to the optical axis.

17. The method as described in claim 14 wherein the step of cutting the plurality of crown main facets includes the step of cutting the plurality of crown main facets at angle *c* to horizontal axis allowing light entering the second light ray path to enter one of the plurality of crown main facets, have more than two internal reflections within the gemstone and exit the table at an angle parallel to the optical axis.

18. The method as described in claim 12, wherein the step of cutting the plurality of crown main facets includes the step of cutting the plurality of crown main facets at angle *c* to horizontal axis allowing light entering the first light ray path to enter the gemstone, have more than two internal reflections within the gemstone and exit the gemstone at an angle parallel to the optical axis.

19. A gemstone produced in accordance with the method described in claim 1.

20. A gemstone produced in accordance with the method described in claim 12.

21. The method as described in claim 1 includes the step of cutting a plurality of crown main facets into a plurality of crown-sub-facets having respectively a plurality of crown main sub-facet angles and the sum of the plurality of crown main sub-facet angles divided by the number of crown sub-facet angles is equal to determined angle *c*.

22. The method, as described in claim 1 includes the step of cutting the plurality of pavilion main facets into a plurality of pavilion main sub-facets having respectively a plurality of pavilion main sub-facet angles and the sum of the plurality of pavilion main subfacet angles divided by the number of pavilion main sub-facet angles is equal to the chosen angle *p*.

* * * * *